US010479670B2

(12) United States Patent
Browne-Wilkinson, Sr.

(10) Patent No.: US 10,479,670 B2
(45) Date of Patent: Nov. 19, 2019

(54) LIQUID DISPENSING DEVICE

(71) Applicants: Oliver Browne-Wilkinson, Sr., Bristol (GB); MODERNISE UK LTD, Cotham, Bristol (GB)

(72) Inventor: Oliver Browne-Wilkinson, Sr., Bristol (GB)

( * ) Notice: Subject to any disclaimer, the term of this patent is extended or adjusted under 35 U.S.C. 154(b) by 82 days.

(21) Appl. No.: 15/300,353

(22) PCT Filed: Apr. 2, 2015

(86) PCT No.: PCT/IB2015/052434
§ 371 (c)(1),
(2) Date: Sep. 29, 2016

(87) PCT Pub. No.: WO2015/151058
PCT Pub. Date: Oct. 8, 2015

(65) Prior Publication Data

US 2018/0179044 A1 Jun. 28, 2018

(30) Foreign Application Priority Data

Apr. 4, 2014 (GB) ..... 1406179.0

(51) Int. Cl.

| | |
|---|---|
| ***B67D 1/12*** | (2006.01) |
| ***B05B 1/14*** | (2006.01) |
| ***B67D 1/14*** | (2006.01) |
| *B05B 1/18* | (2006.01) |

(52) U.S. Cl.
CPC ..... *B67D 1/1272* (2013.01); *B05B 1/14* (2013.01); *B67D 1/1422* (2013.01); *B05B 1/185* (2013.01)

(58) Field of Classification Search
CPC ..... B67D 1/1272; B67D 1/1422; B05B 1/14; B05B 1/185; B05B 1/22
See application file for complete search history.

(56) References Cited

U.S. PATENT DOCUMENTS

| | | | | |
|---|---|---|---|---|
| 4,941,517 | A * | 7/1990 | Galloway | B67B 7/26 141/1 |
| 7,815,079 | B2 * | 10/2010 | Saveliev | B67D 1/0006 141/392 |
| 8,746,506 | B2 * | 6/2014 | Jersey | B67D 1/0021 222/129.1 |
| 2004/0040983 | A1 * | 3/2004 | Ziesel | B67D 1/0051 222/129.1 |
| 2006/0032869 | A1 * | 2/2006 | Younkle | B67D 1/0865 222/399 |
| 2016/0236924 | A1 * | 8/2016 | Hortmanns | B65B 3/22 |

FOREIGN PATENT DOCUMENTS

| | | | | |
|---|---|---|---|---|
| GB | 2373198 | A * | 9/2002 | B67D 1/1405 |

* cited by examiner

*Primary Examiner* — Ryan A Reis
(74) *Attorney, Agent, or Firm* — Crose Law LLC; Bradley D. Crose

(57) ABSTRACT

Typical dispensers of liquids such as for beer often induce froth into the liquid as it is dispensed. This is not always desirable especially if too much froth is produced leading to waste. A liquid dispensing device (10) comprising a plurality of tubes (30) each tube having a diameter less than 2 mm is described to address the issue of over-frothing.

7 Claims, 7 Drawing Sheets

Figure 9
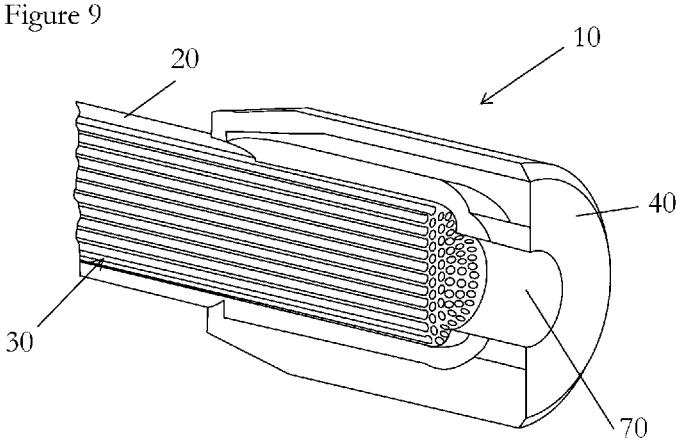
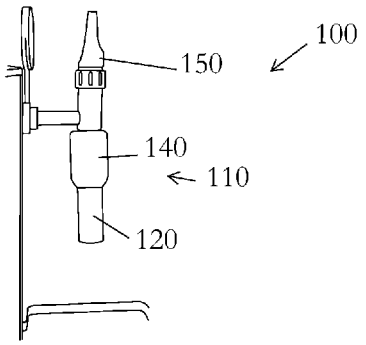
Figure 10

LIQUID DISPENSING DEVICE

FIELD OF THE INVENTION

The invention relates generally to a liquid dispensing device and finds particular, although not exclusive, utility as a beer dispensing device.

BACKGROUND OF THE INVENTION

It is known to dispense beer from a beer tap which is manually moved into an 'on' position to initiate dispensing of beer into a glass, with the beer being pumped or drawn to the tap at a pressure to enhance the flow rate. However, a pressurised method of dispensing causes the liquid to become agitated when leaving the tap and consequently froths in the glass. This requires the liquid to be over-poured by the person in control of the dispensing to achieve a correct measure of liquid, the frothing of the beer is known as 'FOB' (foam on beer).

BRIEF SUMMARY OF THE INVENTION

It is an object of the invention to provide a liquid dispensing device that enables the dispensing of beer to become laminar during the dispensing process to reduce the agitation of the dispensed liquid when leaving the tap and therefore reduce the waste that results from 'FOB' for each correct measure of liquid.

According to a first aspect, the invention provides a liquid dispensing device comprising a plurality of tubes each tube having a diameter less than 2 mm.

The device may be fitted to the dispensing tap or nozzle of a tap, font, pump or other such dispensing device. The plurality of tubes allows a volume of liquid to pass through it at a rate equivalent to existing such liquid dispensers but with the added advantage of avoiding the agitation of the liquid, thus reducing or even eliminating frothing. This is particularly advantageous with carbonated drinks such as beers or sodas. The multiple tubes may be arranged in such a way as to cause the liquid being dispensed along the tubes into laminar flow thus calming the liquid when exiting the dispensing tube into a receptacle.

The term 'dispensing' is also used herein to include the situation where the device is installed between two pipes such that the device is used to calm the liquid travelling (being 'dispensed') from one pipe to another. In this regard, the two pipes may be a single pipe and the device may be installed within the bore of this single pipe. The device may be encapsulated by the pipe or conduit which it is within. It may occupy the entire bore of the conduit such that all fluid flowing through the conduit must pass through the device. The device may be described as laminar flow inducing.

All references to liquid may include fluids and/or gases.

The liquid dispensing device may comprise more than 100 tubes. The liquid dispensing device may comprise more than 200 tubes.

Each tube may have a length in the range 40 to 120 mm, or in the range 60 to 100 mm, or in the range 100 mm to 7000 mm.

Each tube may have a diameter of less than 1 mm, or less than 0.75 mm, or less than 0.5 mm.

The liquid dispensing device may further comprise an outer housing including an attachment means for attaching the device to an outlet of a beer dispenser, the outer housing being configured to prevent any leak of liquid between the outlet of the beer dispenser and the device.

This may be achieved in one embodiment by the outer housing including two attachable parts configured to slightly compress the device when attached together.

The attachment means may be a threaded fitting or a push-fit fitting.

These may allow releasably secure fitting of the device onto an existing beer tap. The releasably securing fitting may be a replaceable component that takes account of possible wear and tear as a result of the liquid dispensing device being taken on and off beer taps for cleaning or location purposes.

The plurality of tubes may comprise rigid or flexible materials.

The bores of the plurality of tubes may be rectilinear and parallel with one another. The plurality of tubes may have straight bores. The plurality of tubes may have bores that are non-circular, for instance, hexagonal, or polygonal.

The plurality of tubes may be encased within an inner housing by friction-fit. The plurality of tubes may be considered a bundle of tubes tightly bound together by the inner housing which may be sheath-like and may slightly compress the bundle.

The plurality of tubes may be bonded together by such means as glue or ultra-sonic welding.

The plurality of tubes may be fabricated as a single component rather than being a bundle of initially separate or discrete tubes.

The device may have an inlet end and an opposite outlet end, and the axes of the plurality of tubes at the inlet end may be substantially parallel to the axes of the plurality of tubes at the outlet end.

The plurality of tubes may have a length:diameter ratio configured to establish the laminar flow of liquid dispensed therethrough, in use.

It is envisaged that in one embodiment substantially all of the spaces between the plurality of tubes are blocked. This may be by means of glue, welding and the like. Alternatively, the spaces between the plurality of tubes may act as tubes themselves. The liquid may be a humanly consumable liquid.

In a second aspect, the invention provides a beer dispenser comprising a liquid dispensing device according to the first aspect.

The plurality of tubes may comprise food grade silicone, food grade plastic, metal or glass. The flexible tubes may be extruded, 3D printed, CNC turned, injection moulded or cast.

In one embodiment, the number of tubes required to make the device practical from the point of view of speed of liquid dispense is 286. This dispenses beer at industry standard rates of between 8 and 12 seconds per pint (568 ml).

By increasing the number of tubes that are secured within the inner housing the flow rate can be increased. Equally by reducing the number of tubes the flow rate can be reduced. It is therefore possible to design and build variations for specific flow rates and hence dispensing times.

Such a device is particularly applicable to the dispensing of beer and other drinks in a public bar as it allows substantial reduction in waste and can increase the delivery time of the product.

The bar worker may place or hold the receptacle under the beer tap and may turn on the beer tap. The liquid flows into the dispensing device and controls the flow of liquid from the tube inlet end to the tube outlet end. The dispensed beer may have a micro bubble foam head as a result of the liquid being dispensed through the liquid dispensing device after being poured. The foam head may be more stable and last for longer on top of the beer. The liquid dispensing device may reduce the carbonation of the beer during the dispensing process that, in turn, may leave a higher carbonated content in the finish dispensed product.

The liquid dispensing device may be integrally formed as part of a beer dispenser that is preferably, but not exclusively, adapted to be assembled onto a font/tap interface so that it may be used on any font poured beverages. It may used with different size glasses and shapes.

In a preferred implementation the liquid dispensing device is adapted to be removed as and when required for cleaning purposes.

The liquid dispensing device allows for substantial control over factors such as the speed of pour and the aeration of different types of liquid when being dispensed. By controlling the flow of beer into a receptacle the beer remains in keg or cask ale condition.

The result is the carbonated content of the keg beers may be maintained thus helping the pint to stay fresh for longer.

In one embodiment, the device may be described as a conduit fluid flow regulator (or conditioner) comprising a plurality of tubes each tube having a diameter less than 2 mm. Some or all of the features described above with regard to the liquid dispensing device may also be applied to such a conduit fluid flow regulator (or conditioner).

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

BRIEF DESCRIPTION OF THE DRAWINGS

FIG. 9 is a cross-sectional view of part of the device of FIG. 7;

FIG. 10 is a view of a typical beer dispensing station;

DETAILED DESCRIPTION OF THE INVENTION

Figure 1:
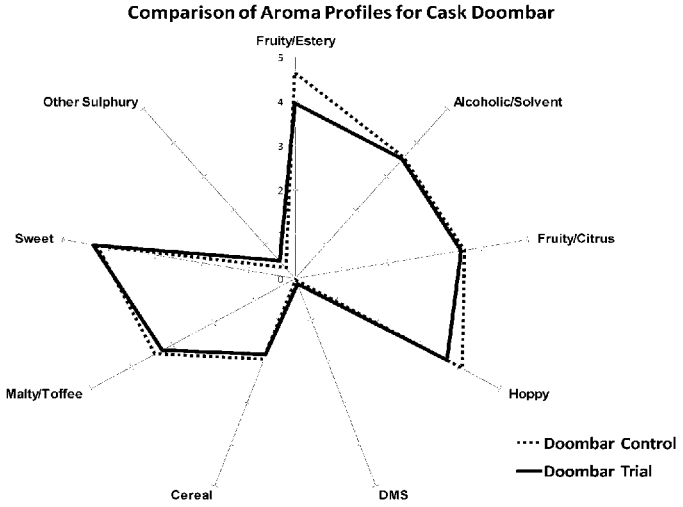
FIG. 1 is a graph showing a comparison of aroma profiles of cask Doombar® beer using a traditional beer dispenser versus a dispenser according to the present invention.
Figure 2:
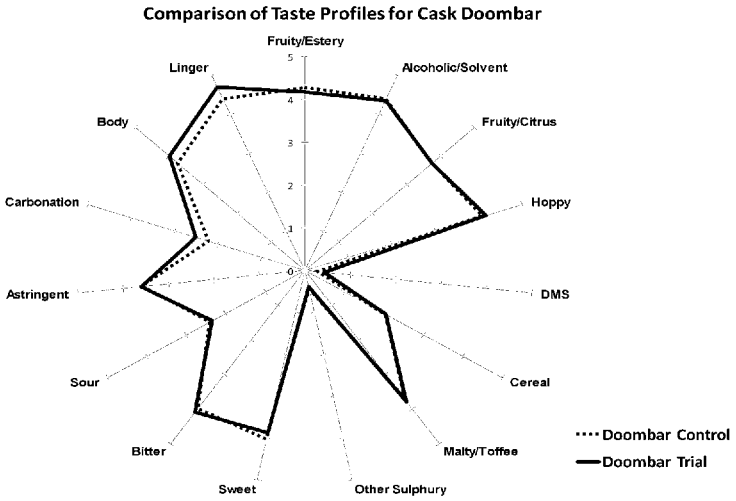
FIG. 2 is a graph showing a comparison of taste profiles of cask Doombar® beer using a traditional beer dispenser versus a dispenser according to the present invention.
Figure 3:
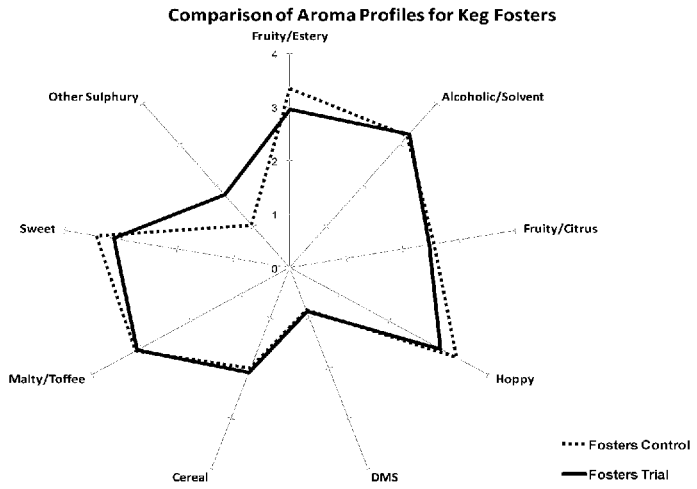
FIG. 3 is a graph showing a comparison of aroma profiles of keg Fosters® beer using a traditional beer dispenser versus a dispenser according to the present invention.
Figure 4:
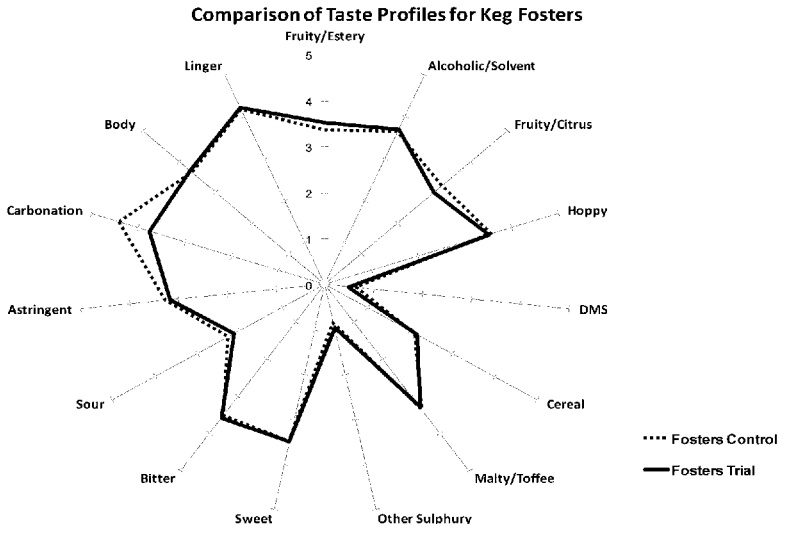
FIG. 4 is a graph showing a comparison of taste profiles of keg Fosters® beer using a traditional beer dispenser versus a dispenser according to the present invention.
Figure 5:
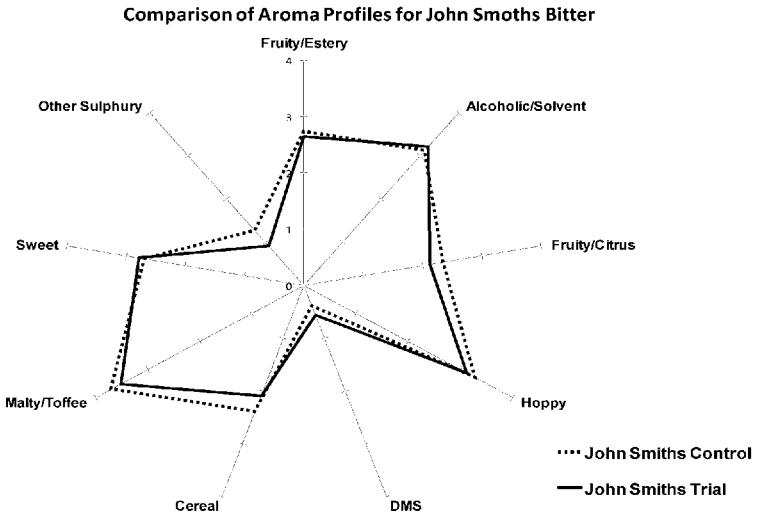
FIG. 5 is a graph showing a comparison of aroma profiles of John Smiths® beer using a traditional beer dispenser versus a dispenser according to the present invention.
Figure 6:
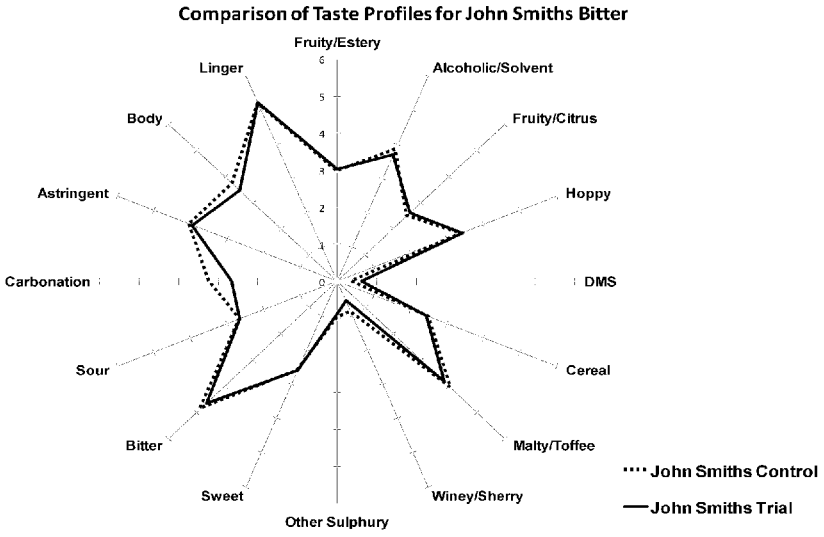
FIG. 6 is a graph showing a comparison of taste profiles of John Smiths® beer using a traditional beer dispenser versus a dispenser according to the present invention.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term 'comprising', used in the claims, should not be interpreted as being restricted to the means listed thereafter, it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression 'a device comprising means A and B' should not be limited to devices consisting only of components A and B. It means that with respect to the present invention, the only relevant components of the device are A and B.

Reference throughout this specification to 'an embodiment' or 'an aspect' means that a particular feature, structure or characteristic described in connection with the embodiment or aspect is included in at least one embodiment or aspect of the present invention. Thus, appearances of the phrases 'in one embodiment', 'in an embodiment', or 'in an aspect' in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term 'at least one' may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

FIGS. 1 to 6 relate to a sensory taste/aroma trial conducted by the Beer Research Institute as shown below.

Cask Doombar® and keg Fosters® and John Smiths® beers were supplied for the evaluation.

All beers were stored at 10-12° C. prior to analysis and dispensed according to their format. The Campden BRI technical flavour panel tasted each beer twice on separate occasions. The beers were served in black glasses and presented anonymously with a three digit code and in a random order using a Random Block design. The products were profiled using predetermined terminology and scored on a 0-9 scale where 0=absent and 9=intense. The data was captured using the CompusenseFive software system.

Any flavours perceived which were not adequately described by the profile terms selected were recorded under the general term 'other'. The tasters were also encouraged to expand their descriptions of the flavour by commenting on the nature of individual notes where appropriate. The brands were assessed to provide a quantitative (numerical value in the form of spider diagrams) and qualitative flavour profile (key flavour notes).

The results are presented as a comparison of aroma and taste profiles for the control beer and trial beers.

From the figures, it is clear that the aroma and taste profiles for the trial beers dispensed through the device according to the present invention did not change greatly as compared to those of the control beers dispensed through traditional means.

The result of using the new device is improved 'body' and 'linger' in cask ales as the aeration of the cask ale may be controlled and reduced in comparison to a normally dispensed cask ale product.

Figure 7:
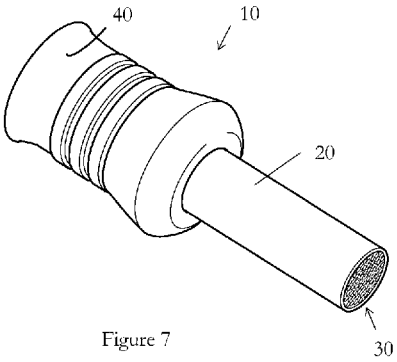
FIG. 7 is a perspective view of a device according to one embodiment of the present invention.

In FIG. 7 the device is indicated 10 comprising an outer housing 40 which retains an inner housing 20. The inner housing 20 is a cylindrical tube comprising a plurality of tubes 30 within. The outer housing 40 comprises a substantially cylindrical body with a means of attachment (not shown) to an existing font at an axial end opposite to the tubes 30.

Figure 8:
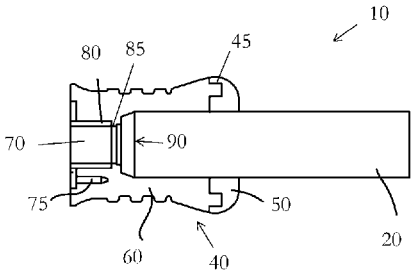
FIG. 8 is a cross-sectional view of the device of FIG. 7.

A cross-sectional view is shown in FIG. 8. The inner housing 20 is seen to extend inside the outer housing 40 at the left hand end and extend outwardly from the outer housing at the right hand end. The left hand end does not extend all the way to the left hand axial end of the outer housing but stops short. It abuts an aperture 70 which is arranged in the left hand axial end of the outer housing 40. A seal 85 is arranged between the end of the inner housing 20 and the wall surrounding the aperture 70 so as to prevent leakage.

An 'o' ring 80 is provided around the inside of the aperture 70 so as to seal against the spigot of the font when it is inserted into the aperture 70, as a push-fit connection. In one embodiment the 'o' ring 90 may be replaced with a thread for screw-fitting connection onto the font.

The left hand axial end of the outer housing 40 which includes the aperture 70, and the 'o' ring 80 and/or screw thread may be a replaceable fitting which may be affixed into the end of the outer housing 40 and retained in place by means of screws 75.

The outer housing 40 comprises two parts 50, 60. The left hand part 60 comprises the left hand axial end, aperture and sealing means 80, 85. The right hand part 50 comprises a smaller portion which is fitted over the inner housing 20 and which is snap-fitted onto the left hand part. The connection 45 between the two parts 50, 60 may comprise snap beads, locking rings, screws, or they may be welded together (possibly by means of ultra-sonic welding).

Although the connection between the font and the device has been described as either push-fit or screw-fit other connection types are contemplated such as the use of locking rings, a click fit and a spin-on fit.

In FIG. 9 another cross-section is shown whereby the multitude of tubes 30 are visible inside the inner housing 20 which projects inside the outer housing 40. The aperture 70 for connection with a font is indicated on the right hand end of the figure.

In FIG. 10 a typical beer dispensing engine/station is indicated 100 comprising the traditional tap 150. A dispensing device 110 has been attached to the outlet spigot of the engine 100. The device 110 comprises an outer housing 140 which has been pushed onto the outlet spigot, and an inner housing 120 comprising a multitude of tiny tubes.

Figure 11:
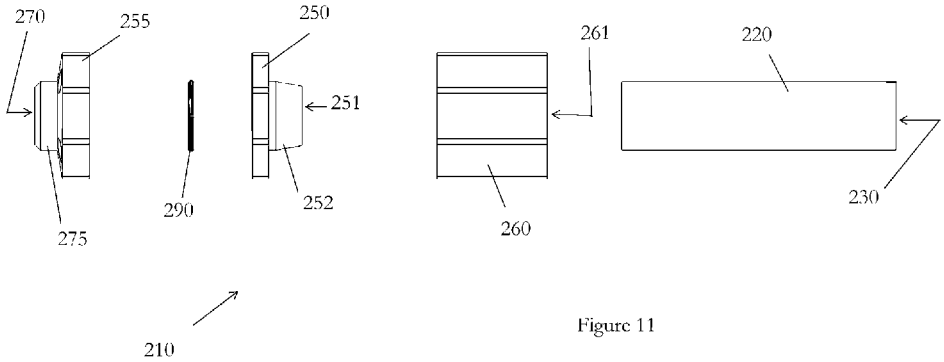
FIG. 11 is an exploded side view of components of an alternative device.
Figure 12:
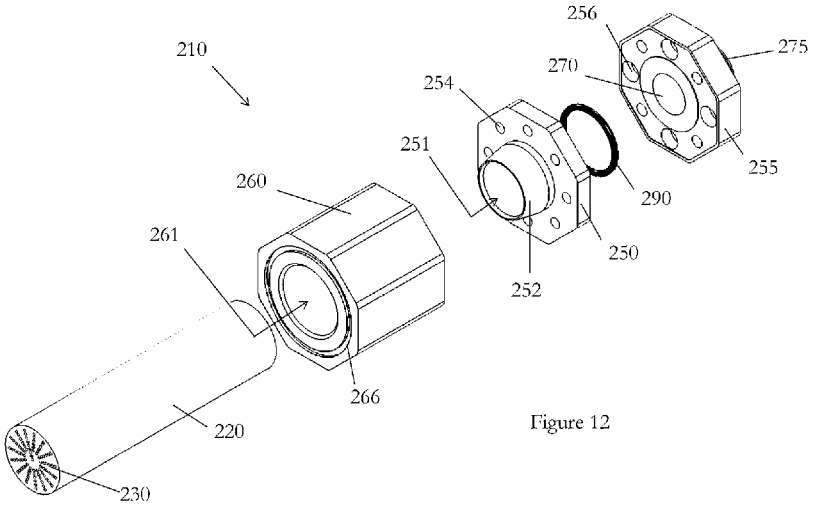
FIG. 12 is a perspective view of FIG. 11.
Figure 13:
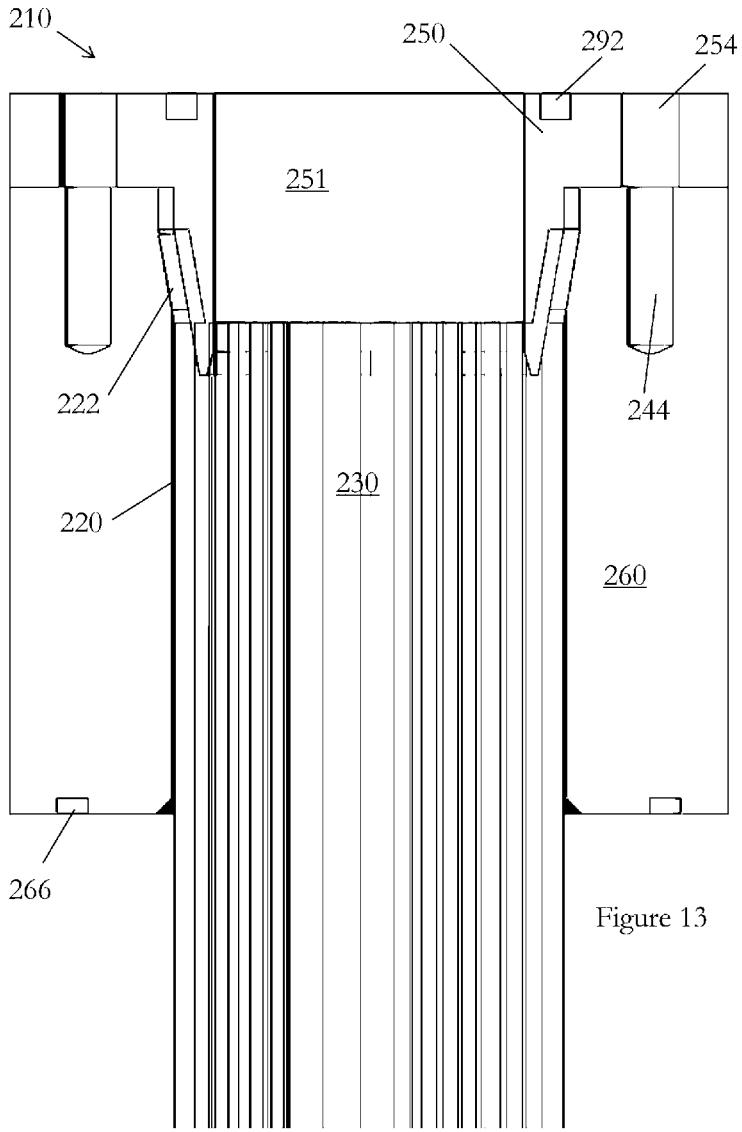
FIG. 13 is a cross-sectional view of a portion of the device of FIGS. 11 and 12 in a partially assembled state.

An alternative device 210 is shown in FIGS. 11 to 13. In FIG. 11 the device 210 is shown to comprise 5 major components. Starting at the right hand end an inner housing 220 is shown comprising a cylindrical tubular body within which are packed a plurality of tiny diameter tubes 230. The inner housing may have a length of approximately 10 cm. The tubes 230 within extend from the right hand end almost all the way to the opposite left hand end of the inner housing 220.

Adjacent to the inner housing 220 is shown an outer housing 260 comprising an octagonal body. It has a bore 261 extending through it for receiving the inner housing 220 as is explained in more detail below. The outer housing may have a diameter of approximately 40 to 50 mm.

Adjacent to the outer housing 260 is a locking ring 250 comprising a spigot 252 on one side for engagement with the end of the inner housing 220. A bore 251 is provided therethrough 251.

Finally, a connection member 255 is provided at the far left hand end for allowing connection of the device 210 with the outlet of a font via a spigot 275 which projects axially away from the side opposite the side which may be attached to the locking ring 250. The spigot 275 includes a bore 275 which may be pushed onto a font outlet or may include a screw thread for attachment thereto.

An 'O' ring 290 is provided between the locking ring 250 and the connection member 255 to prevent leakage therebetween.

In FIG. 12 the features of the device 210 are shown from a different point of view. The end of the inner housing 220 is visible showing a star shape pattern of tubes 230 within. The star shape is representational only as in reality the bore of the inner housing 220 would be full of the tiny tubes.

A drip channel 266 is shown on the outlet end of the outer housing 260. This operates to avoid any liquid running down the outside of the outer housing 260 from reaching the outer surface of the inner housing 220, by intercepting it and forcing it to drip off at that point. The drip channel 266 is located radially spaced from the outer surface of the outer housing 260 and the bore 261 therethrough.

In relation to the locking ring 250 holes 254 are shown arranged radially around the spigot 252. These allow the locking ring to be screwed to the end of the outer housing 260.

The connection member 255 also includes holes 256 arranged radially around the bore 270 to allow it to be screwed to the locking ring 250. This allows for the connection member 255 to be replaced if it wears.

A cross-sectional view of part of the inner housing 220, the outer housing 260, and the locking ring is shown in FIG. 13. The inner housing 220 is shown to include a plurality of inner tiny tubes 230. The axial end 222 of the inner housing 220 nearest the locking ring 250 extends beyond the end of the tubes 230. It is shown having been pushed onto the spigot 252 of the locking ring 250. The spigot 252 flares radially outwardly from its distal axial end to its proximal end (distal being the most distant from the connection member 255 in the assembled state). Consequently, the axial end 222 of the inner housing 220 is forced outward. This provides a firm seal between the inner housing 222 and the spigot 252.

The inner housing 220 is held firmly within the outer housing 260 by a compression, or tight, fit therebetween.

The holes 254 in the locking ring 250 for receiving screws (not shown), for attaching the locking ring 255 to the outer housing 260, are visible together with holes 244 within the outer housing 260 for receiving the screws.

On the axial end of the locking ring 250 (proximal to the connection member 255) an annular groove 292 is provided for receiving the 'O' ring 290.

The drip channel 266 is shown on the opposite axial end.

The device 210 is assembled by pushing the inner housing 220 into the bore 262 of the outer housing 260 such that both ends of the inner housing 220 project either side of the outer housing 260.

The locking ring 250 is then pushed against the end of the inner housing 220 which extends 22 beyond the end of the inner tubes 230 such that the spigot 252 enters into and distorts that end 222. The combined locking ring 250 and inner housing 220 is then pushed axially until the locking ring 250 meets the axial end of the outer housing 260. The two are then screwed together. An 'O' ring 290 is placed in the annual groove 292 on the axial end of the outer housing 260 and the connection member is then connected onto the axial end of the outer housing sandwiching the 'O' ring 290. Screws are used to connect the two although other means are contemplated.

The spigot 275 at the proximal end of the assembled device 210 may be used to connect the device to a beer font in a similar manner to that shown in FIG. 10. Alternatively, a relatively short length of pipe may be connected to the spigot 275 for connection by push-fit means onto the font or other such outlet.

If used within a conduit all but the inner housing 220 may be dispensed with although other mechanisms may be provided to retain the device within the conduit such as flanges, beads, clamps and the like. If used at a junction of two conduits or pipes the device may include a connection mechanism at either end for connecting with the conduits/pipes.

The invention claimed is:

1. A beer dispensing device comprising a plurality of more than 100 tubes each tube having a diameter less than 0.75 mm, wherein each tube has a length in the range 40 to 7000 mm and wherein the tubes have a length:diameter ratio configured to establish laminar flow of the beer dispensed therethrough, in use; wherein the bores of the plurality of tubes are parallel with one another and the plurality of tubes are encased within an inner housing by friction-fit or by bonding.

2. The beer dispensing device according to claim 1, comprising more than 200 tubes.

3. The beer dispensing device according to claim 1, wherein the plurality of tubes has straight bores.

4. The beer dispensing device according to claim 1, wherein the plurality of tubes has bores that are not circular.

5. The beer dispensing device according to claim 1, wherein the plurality of tubes is fabricated as a single component.

6. The beer dispensing device according to claim 1, wherein the device has an inlet end and an opposite outlet end, and the axes of the plurality of tubes at the inlet end are substantially parallel to the axes of the plurality of tubes at the outlet end.

7. The beer dispensing device according to claim 1, wherein substantially all of the spaces between the plurality of tubes are blocked.

* * * * *